US005154348A

United States Patent [19]

Ratnik et al.

[11] Patent Number: 5,154,348

[45] Date of Patent: Oct. 13, 1992

[54] SNOW-GUN OSCILLATION CONTROL APPARATUS

[75] Inventors: H. Ronald Ratnik, Pittsford; John L. Stephens, Geneva, both of N.Y.

[73] Assignee: Ratnik Industries, Inc., Victor, N.Y.

[21] Appl. No.: 698,587

[22] Filed: May 10, 1991

[51] Int. Cl.[5] ..... F25C 3/04

[52] U.S. Cl. ..... 239/14.2; 239/263.1; 318/266

[58] Field of Search ..... 239/2.2, 14.2, 263.1, 239/225.1; 318/266, 280–286, 54, 65, 265, 466, 469

[56] References Cited

U.S. PATENT DOCUMENTS

| | | | |
|---|---|---|---|
| 2,676,471 | 4/1954 | Pierce, Jr. | 239/2.2 |
| 3,761,020 | 9/1973 | Tropeano et al. | 239/14.2 |
| 3,814,319 | 6/1974 | Loomis | 239/14.2 |
| 3,964,682 | 6/1976 | Tropeano et al. | 239/14.2 |
| 4,004,732 | 1/1977 | Hanson | 239/14.2 |
| 4,243,920 | 1/1981 | Brehm | 318/284 |
| 4,386,398 | 5/1983 | Matsuoka et al. | 318/266 |
| 4,689,533 | 8/1987 | Yang | 318/285 |
| 4,985,666 | 1/1991 | Nakabayashi | 318/285 |
| 5,031,832 | 7/1991 | Ratnik et al. | 239/14.2 |
| 5,086,260 | 2/1992 | Ito | 318/266 |

*Primary Examiner*—Andres Kashnikow
*Assistant Examiner*—Christopher G. Trainer

[57] ABSTRACT

Apparatus for repeatedly sweeping a snow-gun nozzle through a desired angular range to more evenly distributed man-made snow produced by a snow-gun. Such apparatus comprises a bi-directional electric motor for driving a rotatably mounted snow-gun support in opposite directions about an axis of rotation, a pair of mechanical stops for limiting rotational movement of the snow-gun support to a predetermined angular range which defines a maximum sweep angle for the nozzle, and circuitry for sensing motor current. A comparator circuit, operatively connected to the output of the current-sensing circuit, functions to reverse the current flow through the motor, thereby changing the direction of rotational movement of the snow-gun support, whenever the current through the motor exceeds a preset threshold level. Such level is reached whenever the support's rotational movement has been limited by one of the two mechanical stops. A variable timer operates to reverse the motor current when a sweep angle less than the maximum sweep angle is desired.

5 Claims, 5 Drawing Sheets

SNOW-GUN OSCILLATION CONTROL APPARATUS

BACKGROUND OF THE INVENTION

This invention relates to the art of making snow for ski resorts and the like. More particularly, it relates to improvements in apparatus for evenly distributing man-made snow with minimal operator involvement.

Though the art of snow-making has been known for several decades, the application of the art to the business of making snow at ski resorts has presented many challenges. While it's a relatively simple matter to combine water and compressed air in such a manner as to produce, under controlled conditions, a uniform blanket of man-made snow, it is considerably more difficult to produce such uniformity on a mountain top where the terrain is steep, the winds shift and the temperature and humidity frequently undergo the type of change that affects the moisture content of the snow produced. For example, it is not uncommon to discover in the morning following a night of snow-making that, as a result of a wind shift or unexpected temperature rise, most of the snow made has either been blown into the woods adjacent the ski trail intended for the deposit, or become so laden with moisture that the "slushy" desposit has frozen to a treacherous mass that, prior to skiing, must either be pulverized or covered over. In either case, most of the cost of the previous night's snow-making operation has been wasted.

To minimize waste of man-made snow, many ski resorts maintain large crews of equipment operators whose job it is to travel the mountainside and make adjustments, as needed, to the "snow-guns", i.e. the snow-making devices which combine water and compressed air in such a manner as to produce a spray of ice crystals. Often, the direction of the spray from these guns must be readjusted to compensate for changes in wind direction and speed, as well as changes in the moisture content of the snow (which determines its weight and, hence, how far it can be projected). Also, the ratio of the water and compressed air must be adjusted, from time-to-time, to compensate for changes in temperature and relative humidity; otherwise, the snow consistency will be either too wet or too dry. As the ambient temperature increases, for example, less water is needed to achieve a nominal snow consistency or quality.

In the commonly assigned U.S. patent application Ser. No. 470,955, filed on Jan. 26, 1990 in the names or H. R. Ratnik et al., there is disclosed an automated snow-making system that significantly reduces the labor costs associated with making the adjustments referred to above. Such a system comprises apparatus for remotely controlling the water/compressed air ratio supplied to the snow-guns, as well as the direction in which the guns project snow. To control the latter, the guns are mounted on a support which, in turn, is rotatably mounted for rotation about horizontal and vertical axes so as to adjust both the elevation and azimuth of the snow-gun nozzle. A pair of remotely controllable motors functions to rotate the gun support about these axes of rotation to provide a nominal aiming position.

While the gun-aiming components of the above-noted system facilitates a nominal setting of the direction in which the gun output is directed, it is often desirable to make frequent azimuth adjustments to compensate for changes in wind speed and direction, as well as temperature and relative humidity changes which, as noted above, affect the weight of the snow. Also, even when the weather conditions are stable, it is usually desirable to make frequent azimuth adjustments so that the snow does not pile up in a relatively small area. As an alternative to making these frequent adjustments, some system operators prefer to allow the snow to pile up for some time and later spread the snow with snow-grooming equipment in order to provide a more uniform snow coverage. Whether making frequent aiming adjustments of the snow-guns, or using heavy equipment to more evenly spread the snow after it has piled up, both of thes approaches to the problem of achieving uniform coverage require the involvement of human forces and/or the use of costly equipment.

SUMMARY OF THE INVENTION

In view of the foregoing, an object of this invention is to reduce the labor and equipment costs associated with the task of uniformly distributing man-made snow.

According to the invention there is provided an apparatus which functions to repeatedly sweep or oscillate the barrel or nozzle of a snow gun through a desired angular range in order to more evenly distribute man-made snow produced by the snow-gun. Such apparatus comprises a bi-directional electric motor which is responsive to an applied current to drive a rotatably mounted snow-gun support in opposite directions about an axis of rotation, mechanical stop means for preventing rotational movement of the snow-gun support in at least one direction beyond a predetermined position, and current-sensing means for producing an output signal indicative of motor current. A comparator circuit, operatively connected to the current-sensing means, functions to reverse the current flow through the motor, thereby changing the direction of rotational movement of the snow-gun support, whenever the output signal from the current-sensing means exceeds a preset threshold level. Such level is reached whenever the support's rotational movement has been limited by the mechanical stop means. Preferably, a variable timer operates to reverse the motor current after the snow-gun support has rotated for a preset time interval in the opposite direction after encountering the stop means. Preferably, a pair of fixed mechanical stops is provided for limiting rotation of the support to a predetermined angular range which defines a maximum sweep angle for the gun support. Alternatively, the position of one of the stops is movable relative to the other to provide a variable sweep angle; in this case, the timer component may be eliminated. Preferably, the comparator circuit is inhibited, for a brief period of time, each time the motor current is reversed.

The current-sensing, sweep control apparatus of the invention is particularly advantageous in that it requires no limit switches, encoders or the like which, in snow and icy conditions, can freeze-up and stop working.

The invention and its various advantages will be better understood from the ensuing detailed description of preferred embodiments, reference being made to the accompanying drawings.

DETAILED DESCRIPTION OF PREFERRED EMBODIMENTS

Figure 1:
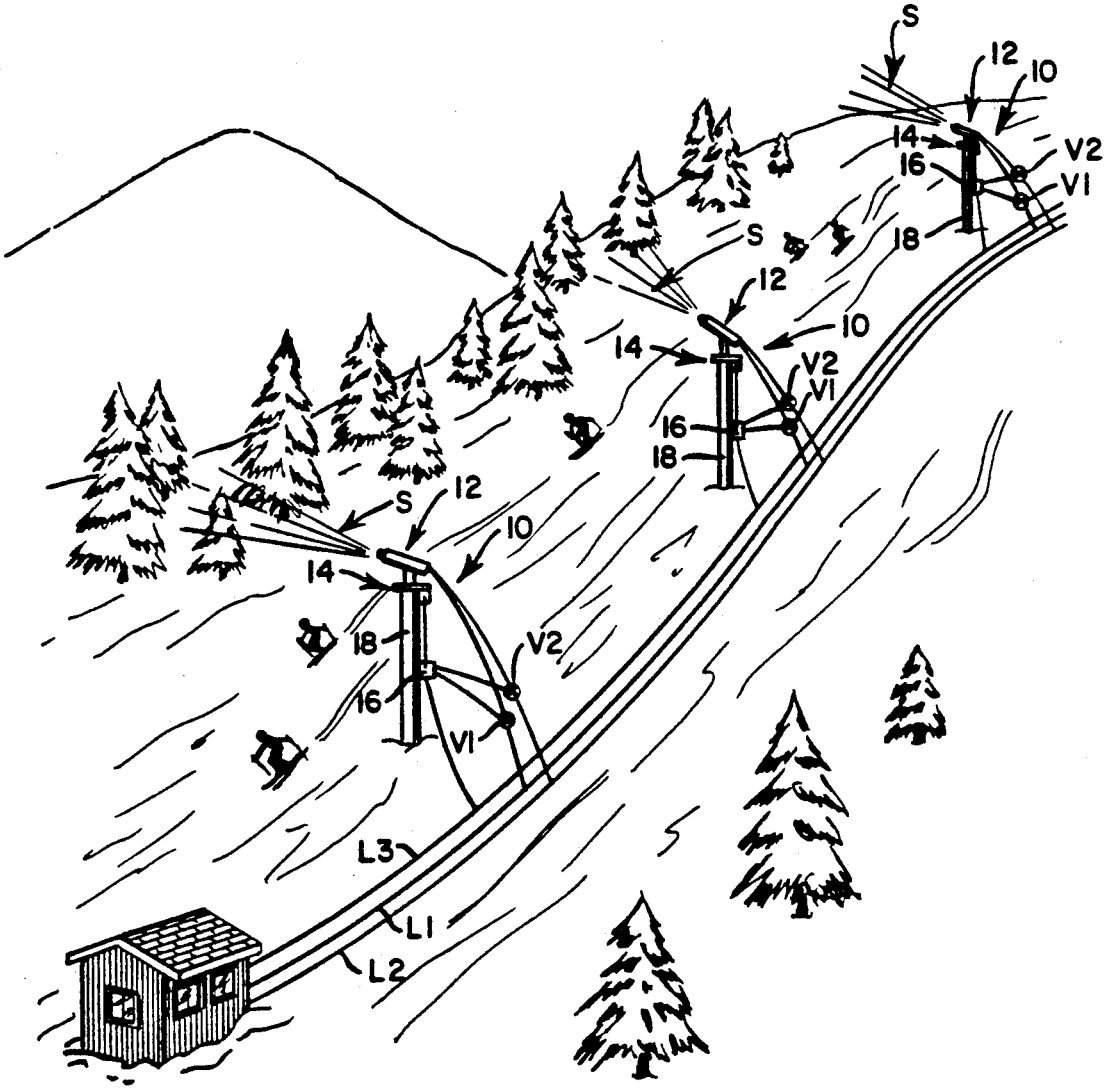
FIG. 1 is a diagrammatic illustration of a snow-making system in which the invention has utility.

Referring now to the drawings, FIG. 1 diagrammatically illustrates a snow-making system embodying the present invention. Such system comprises a plurality of snow-making sites 10 arranged at various locations along the ski trails of a ski resort. Each installation comprises a snow-gun 12 which is mounted on a motor-controlled mount 14. Suitable snow-guns are disclosed, for example, in U.S. Pat. No. 3,829,013, issured to H. R. Ratnik. Such guns function, in a well known manner, to provide a spray S of ice crystals (i.e. snow) upon combining water and compressed air under certain conditions which need not be described here. It suffices to say that the consistency of "quality" of the snow produced by these devices depends primarily on the existing atmospheric conditions and the relative proportions of the water and compressed air supplied to such devices. Water under high pressure and compressed air are supplied to each gun by water and compressed air lines L1 and L2, respectively. Motor-controlled valves V1 and V2, control the flow of water and air to the snow-guns. The operation of such valves, as well as the operation of the motor-controlled mounts, are controlled by output of a control circuit 16 associated with each installation. As described in the above-reference U.S. application Ser. No. 470,955, each contol circuit 16 can be operated from a remote location, preferably by a hand-held transmitter carried and operated by a person who is in a position to be physically sample the man-made snow, as it falls, and to observe, first-hand, the location of the snow deposit. The disclosure of this application is hereby incorporated herein by reference.

Figure 2:
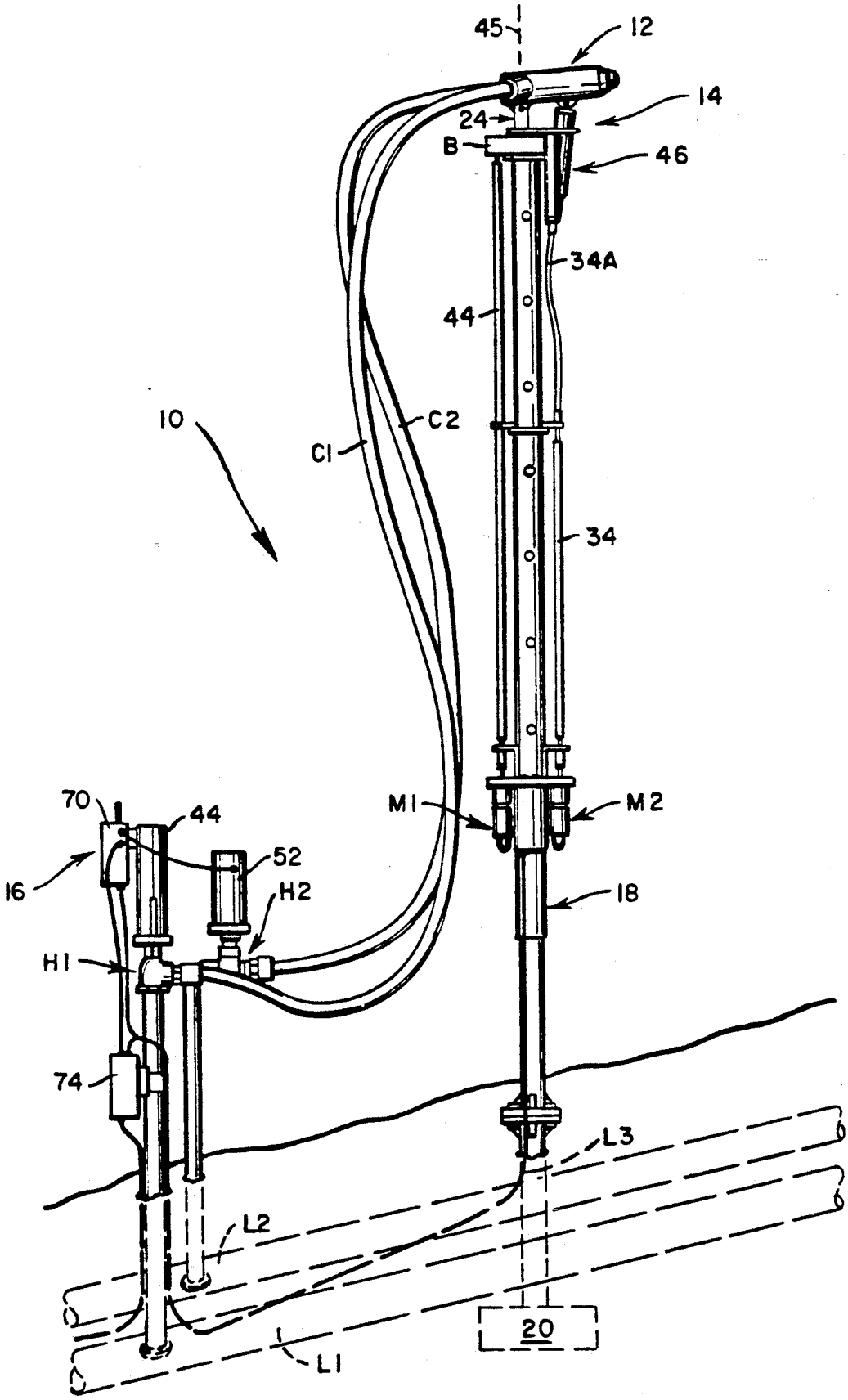
FIG. 2 is a side elevation of a snow-making component of the FIG. 1 system.

Referring to FIG. 2 which better shows the mechanical details of each snow-making site, each snow-gun 12 is supported by its motor-controlled mount 14 atop a telescoping tower 18 extending upwardly from a concrete base 20 buried beneath ground level. Water is supplied to each gun 12 via a conduit C1 attached to an adjustable hydrant H1. The flow rate of the water hydrant is controlled by a motorized valve 44 operated by control circuit 16. Similarly, compressed air is supplied to each gun via a conduit C2 attached to an adjustable hydrant H2 having a flow rate controlled by a motorized valve control mechanism 52. Motors M1 and M2 control the azimuthal and elevational positions of each gun, as explained below.

Figures 3A, 3B:
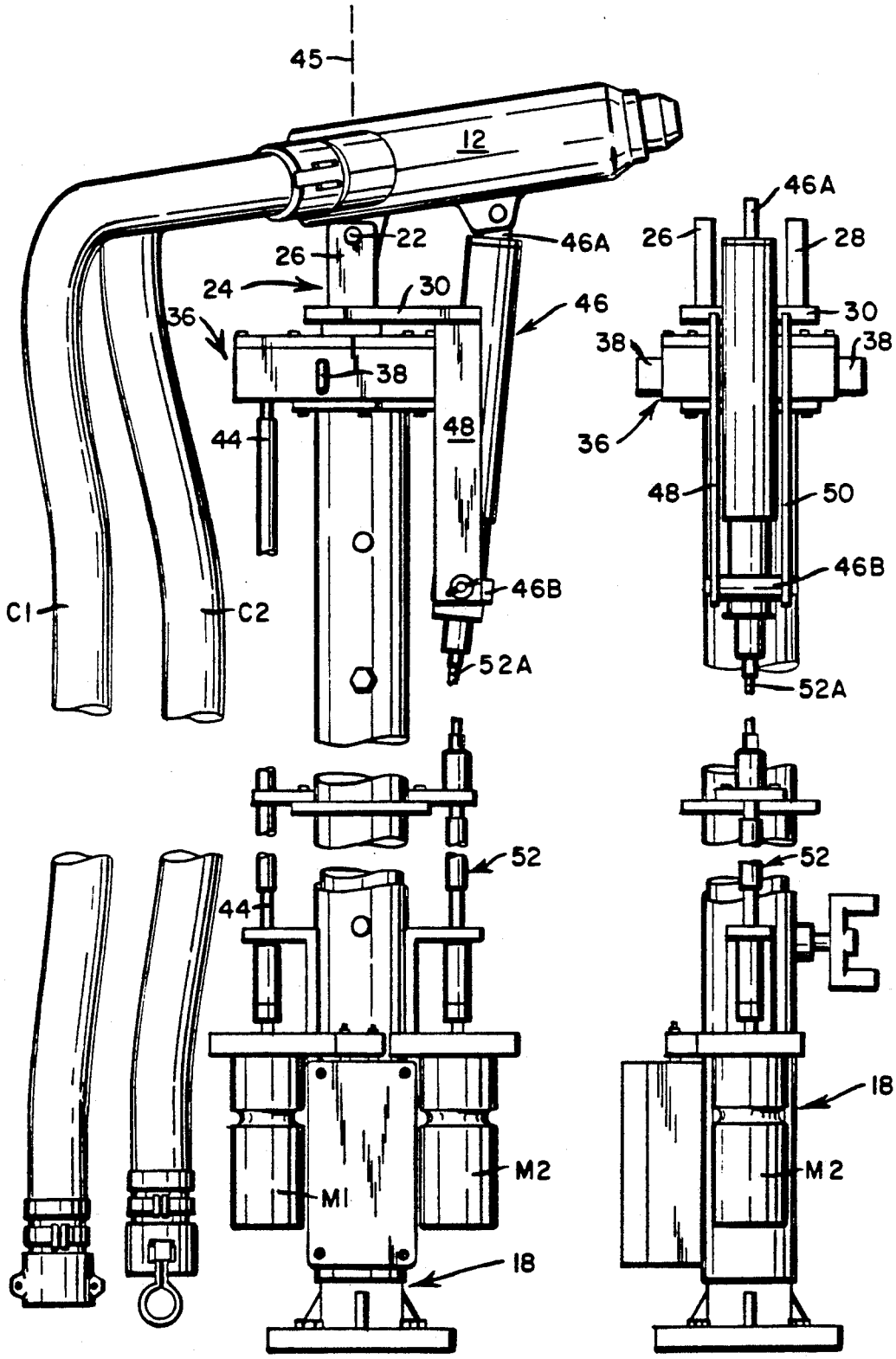
FIGS. 3A and 3B are front and side elevations, respectively, of a motor-controlled support for controlling the direction of snow projection by a snow-making device.
Figure 4:
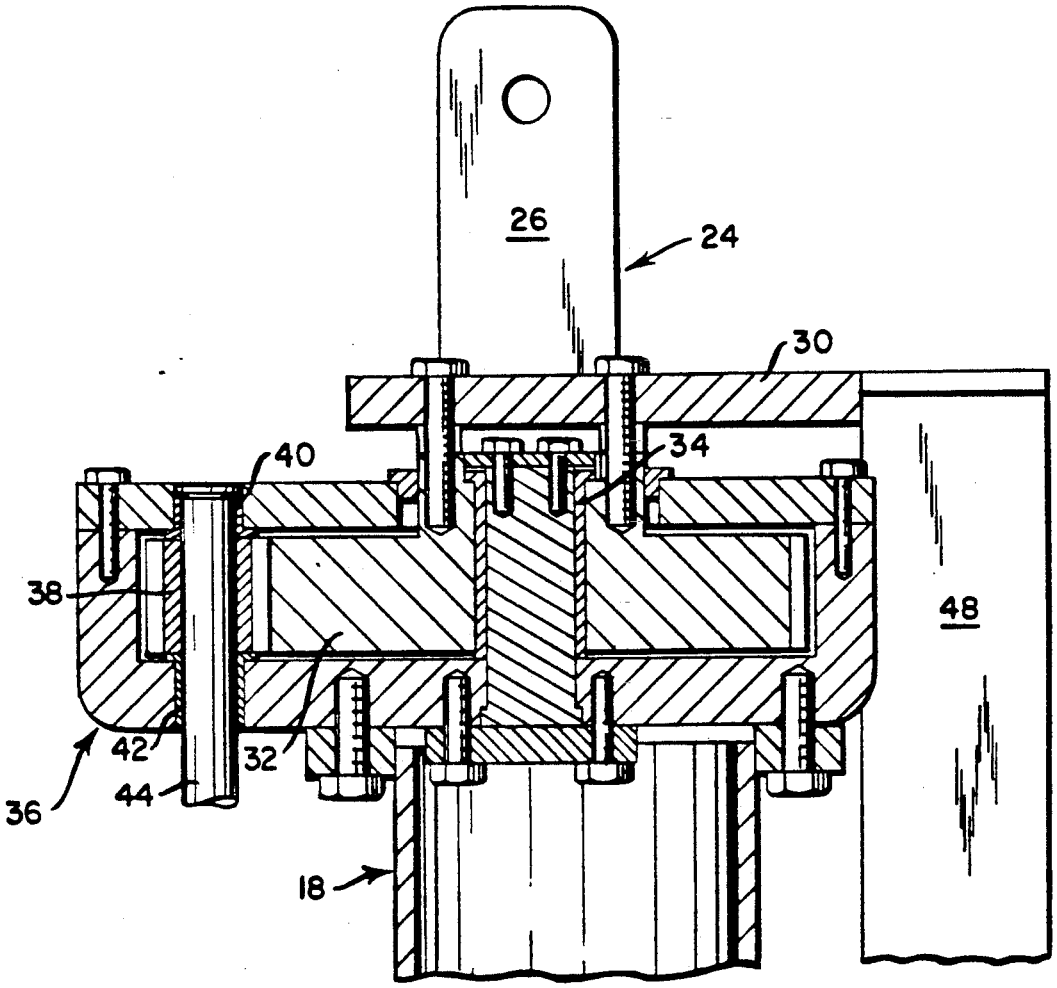
FIG. 4 is a cross-sectional view of a portion of the apparatus shown in FIGS. 3A and 3B.

The structural details of each gun mount 14 are shown best in FIGS. 3A, 3B and 4. Gun 12 is pivotally supported on a pivot pin 22 so that its elevational position can be adjusted about the horizontal axis defined by the longitudinal axis of the pin. Pin 22 is supported between a pair of upright members 26,28, comprising a weldment extending upwardly from a base plate 30. The elevational position of the gun nozzle or barrel is controlled by a jack screw 46, one end 46A of which is connected to the gun, and the other end 46B connected to weldment 24, via a pair of downwardly extending members 48,50 rigidly connected to plate 30. As explained below in connection with the azimuth control of the gun, members 48,50 cooperate with a pair of tabs 38 extending from the outer surface of a gear box 36 to prevent azimuthal rotational rotation of the gun support beyond a certain point in either direction, thereby defining a maximum sweep angle. Jack screw 46 is selectively driven by motor M2 to either raise of lower the elevational position of the gun about pin 22. Motor M2 drives the jackscrew through a drive shaft 52, aportion 52A of which is flexible to accomodate the movement of the gun support about vertical axis 45.

The azimuthal position of the snow gun is controlled by motor M1 via a gear box 36. As shown in FIG. 4, plate 30 is rigidly connected to a spur gear 32 which is rotatably mounted by a sleeve bearing 34 within a gear box 36. The gear box is rigidly connected to the top of tower 18 and, hence, remains stationary during azimuth adjustments of the snow-gun. Spur gear 32 is rotatably driven by a pinion gear 38 which is rotatably mounted in the gear box by a pair of bearings 40,42. The spur gear is keyed to a drive shaft 44 driven by motor M1 which, like motor M2, is rigidly mounted on the upper, telescoping portion of tower 18. When energized, motor M1 causes weldment 24 to rotate clockwise or counter-clockwise in a horizontal plane, thereby adjusting the azimuthal position of the snow-gun about the vertical axis 45.

Control over the operation of motors M1 and M2 is provided by control circuit 16 which, as shown, may be housed in a weather-tight housing 70 attached to the water hydrant's protective housing 44. Electric power for the motors and control circuit may be provided by a re-chargeable, low voltage, battery pack. However, it is preferred that the necessary power be provided by buried high voltage lines L3 (e.g. 110 or 220 volt AC power) and a suitable step-down transformer and DC converter 74.

The apparatus for initially aiming the snow-gun in nominal azimuthal and elevational directions is well described in the aforementioned Ratnik et al. disclosure. In accordance with the present invention, however, there is provided additional apparatus, including circuitry, for oscillating the gun, after it has been initially aimed, to provide a more uniform distribution of snow over a broader area. Preferably, such apparatus operates to oscillate the gun in the horizontal plane; however, as will be readily apparent, the apparatus could be modified to oscillate the gun in a vertical plane, to achieve the same purpose.

The gun oscillating apparatus of the invention basically comprises a bi-directional DC motor, such as motor M1, and means for switching the direction of current flow through the motor at appropriate times to cause the motor to rotate the gun support in one direction about axis 45, and then, after the gun has swept through a desired arc, to rotate the gun support in the reverse direction. While this current-switching can be readily accomplished with various limit switches, encoders, and the like, such devices tend to be too delicate for use in the inclement conditions normally encountered in snow-making. The current-switching apparatus of the invention is far more rugged and can readily withstand such conditions. Such apparatus includes means for physically stopping or arresting rotation of the gun support at a certain point in its travel, and current-sensing means for providing a signal proportional to the level of current drawn by the motor. Naturally, the level of motor current dramatically increases when rotation of the gun support is arrested, and means are provided for producing a current-switching signal when the motor current exceeds a preset threshold level. Upon switching the direction of motor current, the gun support rotates in the opposite direction until another rotation-arresting mechanism is encountered, at which time the motor current increases to the threshold required to produce a second current-switching signal. And so forth.

Referring to FIGS. 3A and 3B, it will be seen that the gear box 36 has outwardly extending tabs 36 which, as noted above, are encountered by the downwardly extending members 48,50, as the gun support plate 30 rotates under the influence of motor M1. Either of these tabs, upon being engaged by either to members 48 or 50, prevents further rotation in the direction of contact, causing the motor current to rise. The motor current is then reversed, causing the gun support to rotate until the other tab engages the other of members 48,50. As shown, the tabs are set at a nominal spacing of about 180 degrees, thereby allowing the gun mount to rotate through a comparable arc (actually somewhat less due to the spacing of members 48,50) before the motor current is switched.

To provide an adjustable sweep angle, the position of one of the tabs may be adjustable, toward or away from the other tab. A drawback of this approach is that such an adjustment could be difficult to effect when the gun mount is many feet above ground level. A better approach is to provide an adjustable timing circuit which can be remotely controlled, in the manner described in the aforementioned Ratnik et al. application, to provide a current-switching signal at the end of a preselected time interval correlated with a desired sweep angle. Such a timing circuit is used, in cooperation with one physical stop to control the period of oscillation. A circuit for implementing the control functions described above is shown in FIG. 5.

Figure 5:
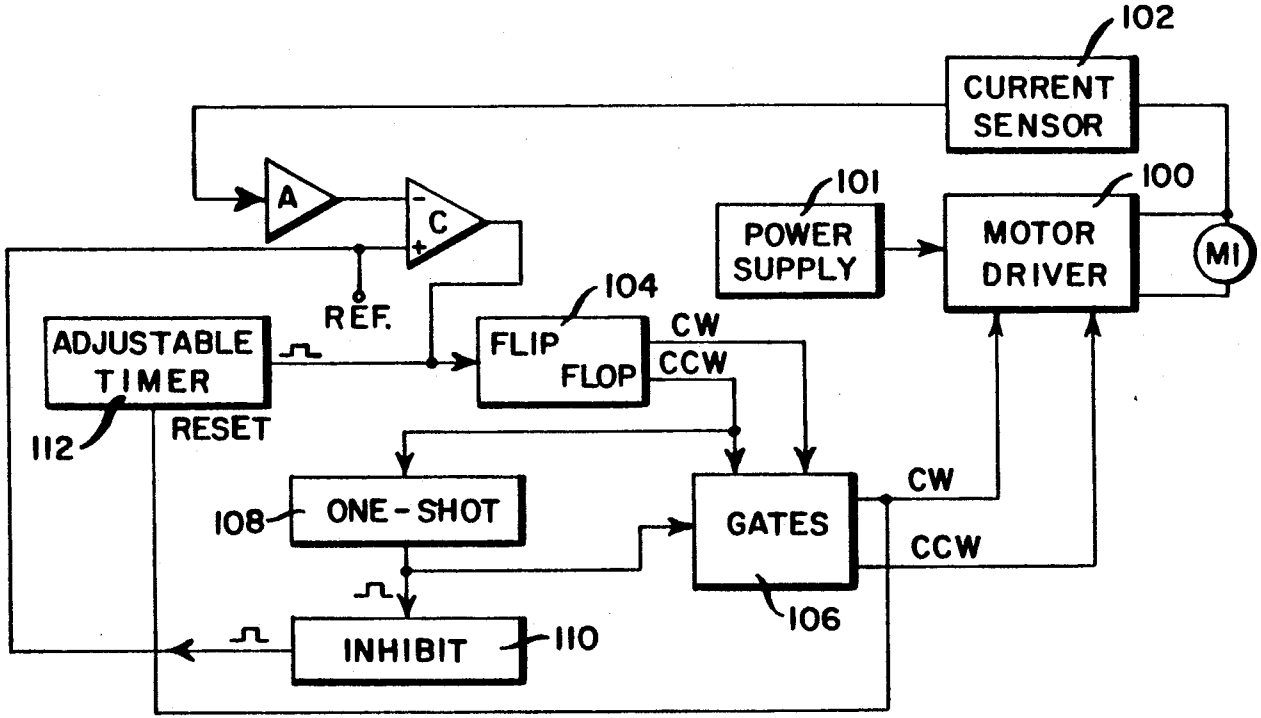
FIG. 5 is a schematic block diagram of a control circuit for controlling the operation of the position-controlling motors shown in FIGS. 3A–3B and 4.

Referring to FIG. 5, current is supplied to motor M1 by a motor controller, such as a MOSFET H-bridge 100, manufactured and sold by Texas Instruments. Such a device is powered by a DC power supply 101 and has a current-sensing terminal, schematically represented by the current-sensing circuit 102. The output of circuit 102 is suitably amplified by amplifier A, and the output of the latter is compared with a reference voltage, REF, by a comparator C. When the amplified output of circuit 102 exceeds the threshold set by the reference voltage, the comparator puts out a current-switching signal to a flip/flop circuit 104. Responsive to this signal, the flip/flop provides either a "high" clockwise signal CW, and a "low" counter-clockwise signal CCW, or vice-versa, depending on the logical states of the flip/flop output signals at the time of receipt of the input from the comparator circuit. The outputs of the flip/flop are fed to a logic gate 106 which transmits such signals to the motor controller except during a brief time interval (e.g. one-tenth of a second) established by a monostable multivibrator circuit or "one-shot" 108. During this time interval, the field of the motor collapses and the motor abruptly stops. This brief time interval when no current is applied to the motor prevents "plugging" of the motor (i.e., rapid switching of polarity) and reduces the effects of surge currents. The output pulse from the one-shot is triggered from either the leading or trailing edge of the CCW signal provided by the flip/flop. The output of the one-shot also triggers an inhibit circuit 110 (also a one-shot circuit) which produces a 0.5 pulse signal which is used to drive the comparator's reference voltage to a high level so that the comparator cannot produce a current-switching signal until after the switched motor current has stabilized.

In order to switch the motor current before the comparator output produces a current-switching signal (so as to shorten the sweep angle to a value less than the maximum sweep angle established by the position of tabs 38), an adjustable timing circuit 112 is provided. Timer 112, also a one-shot circuit, provides a pulse of an adjustable time interval to the flip/flop circuit, causing the flip/flop to change states when the timer has timed-out. Thus, by selecting a time interval shorter than the time required for the gun support to rotate from a position in which one tab engages one of the members 48,50 to a position in which the other tab engages the other member, any sweep angle can be achieved.

From the foregoing, it will be appreciated that the aforedescribed, labor-intensive task of snow distribution has been automated to a major extent by the apparatus of the invention. As a result, the cost of making snow can be reduced.

While the invention has been described with particular reference to a preferred embodiment, it will be appreciated that modifications can be made without departing from the spirit of the invention. Such variations are intended to fall within the scope of the appended claims.

What is claimed is:

1. Apparatus for repeatedly sweeping a snow-gun nozzle through a desired angular range to more evenly distribute man-made snow produced by a snow-gun, said apparatus comprising:

(a) a bi-directional electric motor responsive to an applied current for driving a rotatably mounted snow-gun support in opposite directions about an axis of rotation;

(b) mechanical stop means for preventing rotational movement of the snow-gun support in a first direction beyond a predetermined position;

(c) current sensing means for producing an output signal proportional to the level of current applied to said motor;

(d) comparator circuit means, operatively connected to the output of the current-sensing means for producing a current-reversing signal whenever the current through the motor exceeds a preset threshold level, said level being exceeded whenever the snow-gun support is being prevented from rotating by said mechanical stop means; and (e) means responsive to said current-reversing signal to reverse the direction of current flow in said motor to reverse the direction of rotation of said snow-gun support.

2. The apparatus as defined by claim 1 further comprising variable timing means for reversing the motor current after said snow-gun support has rotated in a direction opposite said first direction for a time interval established by said timing means.

3. The apparatus as defined by claim 1 wherein said stop means comprises two mechanical stops for limiting rotational movement of said snow-gun support to a predetermined maximum angular range.

4. The apparatus as defined by claim 1 further comprising circuit means for temporarily interupting current flow to said motor for a predetermined time interval immediately following the production of said current-reversing signal.

5. The apparatus as defined by claim 1 further comprising circuit means for preventing said comparator circuit means from producing a second current-reversing signal for a predetermined time period following the production of a first current-reversing signal.

* * * * *